United States Patent [19]

Bretschneider et al.

[11] Patent Number: 4,802,600

[45] Date of Patent: Feb. 7, 1989

[54] FREIGHT CONTAINER FOR AIR TRANSPORT

[75] Inventors: Gerd Bretschneider, Hilzingen; Dieter Kiesewetter, Radolfzell, both of Fed. Rep. of Germany

[73] Assignee: Swiss Aluminum, Chippis, Switzerland

[21] Appl. No.: 125,479

[22] Filed: Nov. 25, 1987

[30] Foreign Application Priority Data

Dec. 1, 1986 [DE] Fed. Rep. of Germany ... 8632203[U]
Apr. 14, 1987 [DE] Fed. Rep. of Germany ..... 3712695

[51] Int. Cl.[4] ..... B65D 88/52

[52] U.S. Cl. ..... 220/1.5; 220/84; 220/334

[58] Field of Search ..... 220/1.5, 84, 334; 49/94, 104

[56] References Cited

U.S. PATENT DOCUMENTS 3,294,034 12/1966 Bodenheimer et al. ..... 220/1.5
3,645,596 2/1972 Russell-French ..... 220/1.5 X
3,907,148 9/1975 Meller et al. ..... 220/1.5
4,046,186 9/1977 Nordstrom ..... 220/1.5 X
4,046,277 9/1977 Morrison ..... 220/1.5
4,212,406 7/1980 Mittelmann ..... 220/84 X
4,249,852 2/1981 Alstad ..... 220/334 X
4,574,968 3/1986 Mittelmann ..... 220/1.5

FOREIGN PATENT DOCUMENTS 2119536 6/1972 Fed. Rep. of Germany .

*Primary Examiner*—Steven M. Pollard
*Attorney, Agent, or Firm*—Bachman & LaPointe

[57] ABSTRACT

A freight container for air transport has a support frame which is arranged on a baseplate, sections rising from the baseplate and transverse sections, connecting these, for a container roof, sheeting which at least partially fills in the support frame. One side of the freight container is provided with a loading opening, immediately adjoining the lateral loading opening, there is a gap in the container roof and this gap can be closed by a pivotable or displaceable portion of the container roof.

8 Claims, 5 Drawing Sheets

FREIGHT CONTAINER FOR AIR TRANSPORT

BACKGROUND OF THE INVENTION

The invention relates to a freight container for air transport having a support frame which is arranged on a baseplate, has sections rising from the baseplate and transverse sections, connecting these, for a container roof, and is provided with sheeting which at least partially fills in the support frame, one side of the freight container being provided with a loading opening.

A freight container of this kind is disclosed in German Offenlegungsschrift DE-OS No. 2,119,536. The side walls described in that text comprise two parallel vertical pillars which are connected by a ridge section. A projecting part of the ridge section overlaps a side wall zone which extends beyond the baseplate, is framed by sections and, from the baseplate to about half the height of the side wall, has a sloping edge.

This shape of the freight container enables it to fit the round or oval cross-section of an aircraft fuselage and is indispensable for air freight containers.

The disadvantage of this prior art has proved to be that the lateral loading opening is frequently insufficient for the loading operation. Where relatively large pieces of cargo are concerned, net-covered pallets therefore have to be used.

SUMMARY OF THE INVENTION

Faced with these facts, the inventor has set himself the object of improving the loading capabilities of freight containers of this type while at the same time ensuring adequate stability combined with light weight and making possible simple assembly.

This object is achieved by the fact that, immediately adjoining the lateral loading opening, there is a gap in the container roof and this gap can be closed by pivotable or displaceable portion of the container roof. This is preferably a fold-back cover, which is articulated approximately at the center axis of the container roof and comprises a section frame of which one part terminates at both ends at rising sections of the support frame in the manner of a ridge section although it is not fixed to them.

Of particular important for the invention is the transverse reinforcement of the freight container by bilateral connecting sections which are both fixed at both ends to the support frame and, with a molded extension, overlap a longitudinal edge of the adjacent sheeting and are also fixed to the outer surface of the latter. It has proven advantageous to step this connecting section, as seen in cross-section, so that one of these steps can overlap the upper edge of the sheeting, thereby making it completely unnecessary to provide the container roof with a special seal.

On at least one narrow side, freight containers of this kind have a so-called container overhand, i.e. an inclined part which projects out from one end face and, for example, may be defined by sloping side sections as described in German Patent DE-PS No. 3,428,109. In such a case, the inclined sections can be connected to the support frame by means of the connecting section and additional reinforcing elements, which would increase the weight, are thus no longer needed. To achieve this, the connecting sections are connected at their ends by angular butt straps, which are riveted to the rising sections.

Of particular importance for the tightness of the structure is a novel embodiment of a pair of frame sections, one of which is associated with the fold-back cover and the other is associated with the fixed roof part, and is connected by a hinge.

The specific embodiment of the present invention of the cross-sections of the mutually associated frame sections ensures the maximum tightness of the roof and this can be additionally ensured, according to the invention, by the insertion of a sealing section.

Overall, the result is a simple and economical freight container having an enlarged loading opening which fulfills the objectives of the present invention.

BRIEF DESCRIPTION OF THE DRAWINGS

Further advantages, features and details of the invention will emerge from the description of preferred exemplary embodiments which follows and from the drawings, in which.

DETAILED DESCRIPTION

Figure 1:
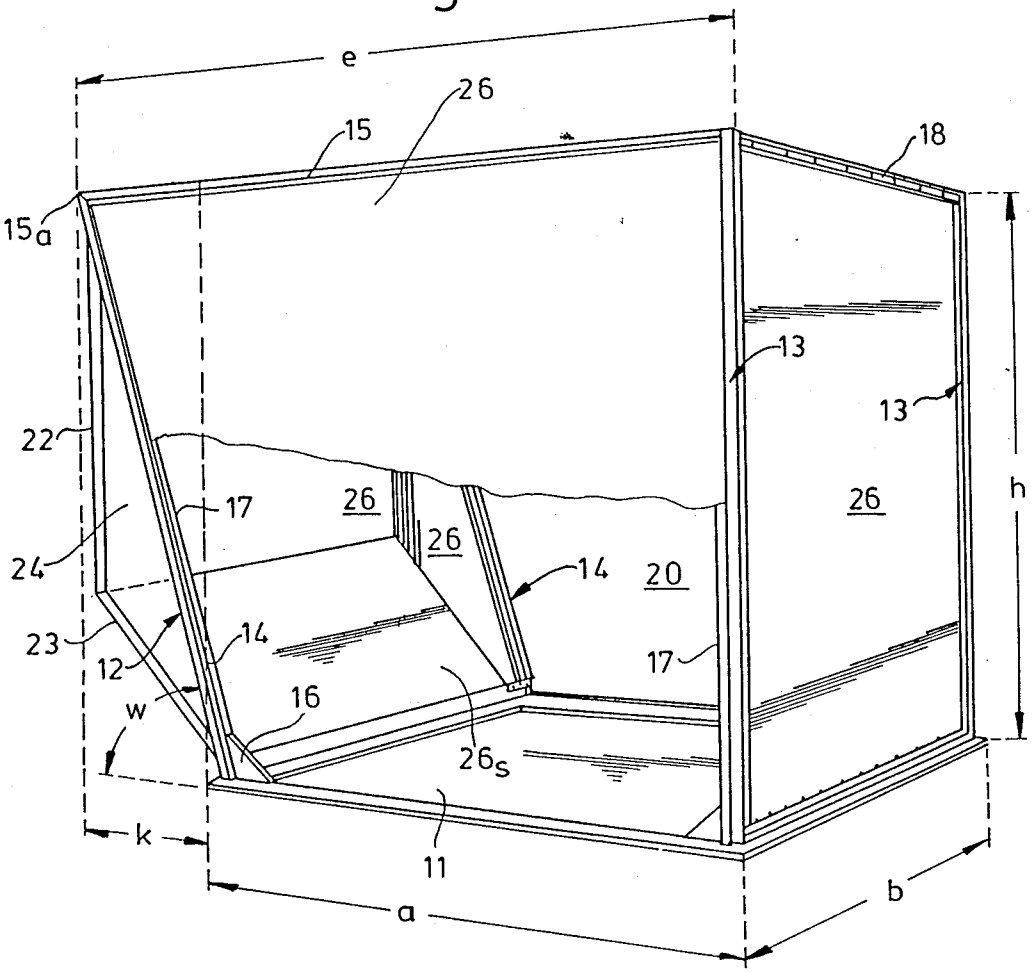
FIG. 1 shows an oblique view of a partially sectioned freight container for air freight.

A freight container 10 of a height h of, in this case 1162 mm for air freight is provided, using a baseplate 11 of a length a of, for example, 1562 mm and a breadth b of 1494 mm, with a support frame which has a rear side frame 12, seen in the foreground in FIG. 1, and a vertical section 13, an inclined section 14, which slopes outwards at an angle w of about 75°, and a ridge section 15, the individual parts being connected by corner plates 16. The opposite longitudinal side of the freight container 10 also exhibits a vertical section 13 and an inclined section 14, and the two delimit a side opening 20 which can be closed by means of a tarpaulin and are connected by transverse sections 18, 19 to the corresponding section 13, 14 of the rear side frame 12.

The ridge section 15 is approximately 1980 mm long (dimension e) and projects by an amount k of approximately 450 mm beyond the baseplate 11. The projecting face 15*a* of the ridge section 15 is connected to the baseplate 11 by the said inclined section 14 and at the projecting face 15*a* each inclined section 14 adjoins a vertical bar 22 which ends at a distance from the plane of the baseplate 11 and is connected to the region of the said baseplate 11 by means of a sloping base bar 23. Together with the two bars 22, 23, the inclined section 14 forms a triangular frame and hence the contour of a so-called container overhang 24.

Apart from the side opening 20, the resulting lateral framed areas of the freight container 10 are provided with metal plates 26 as sheeting, which in turn is fastened by means of rivets to section webs 17 of sections 13, 14, 15, 18, 19 or the like.

Figure 2:
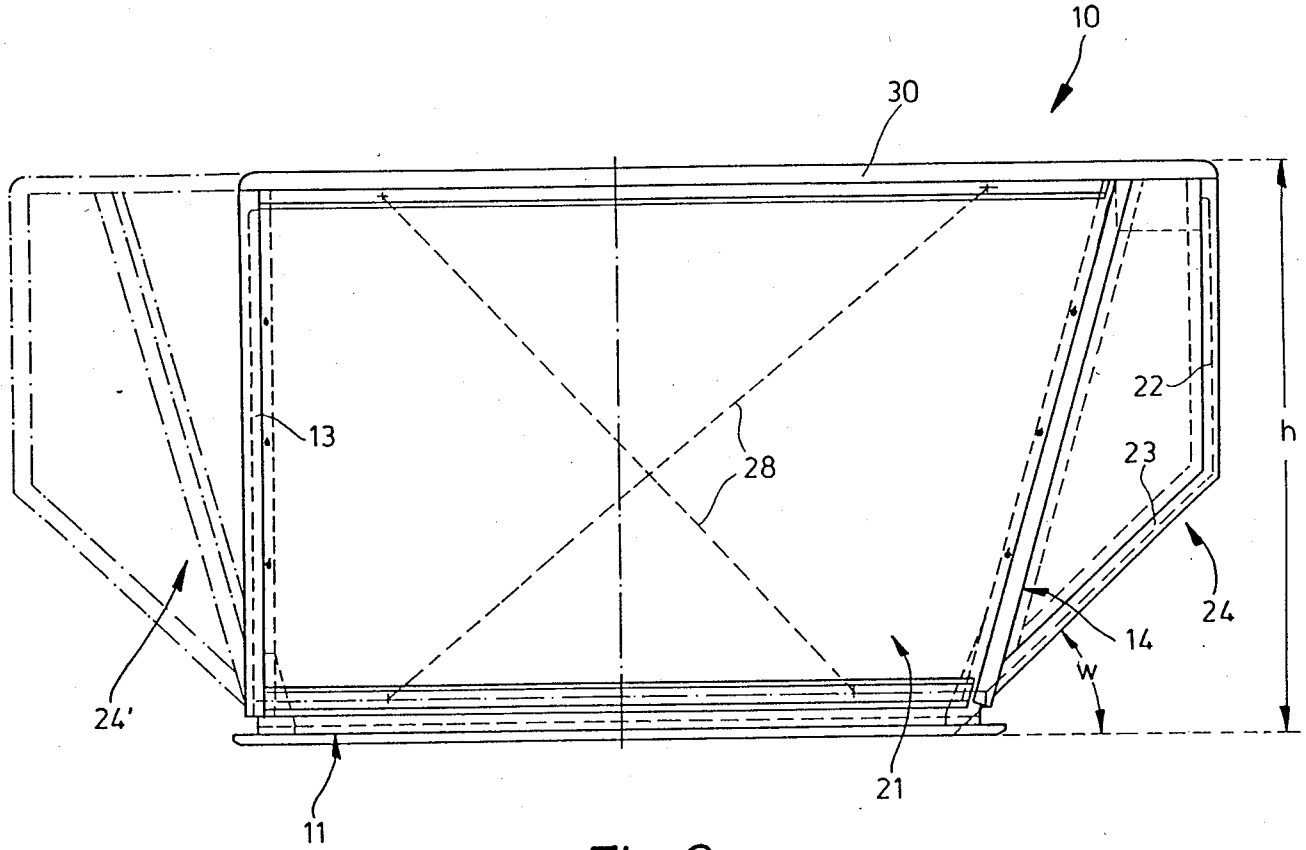
FIG. 2 shows a side view of FIG. 1.
Figure 3:
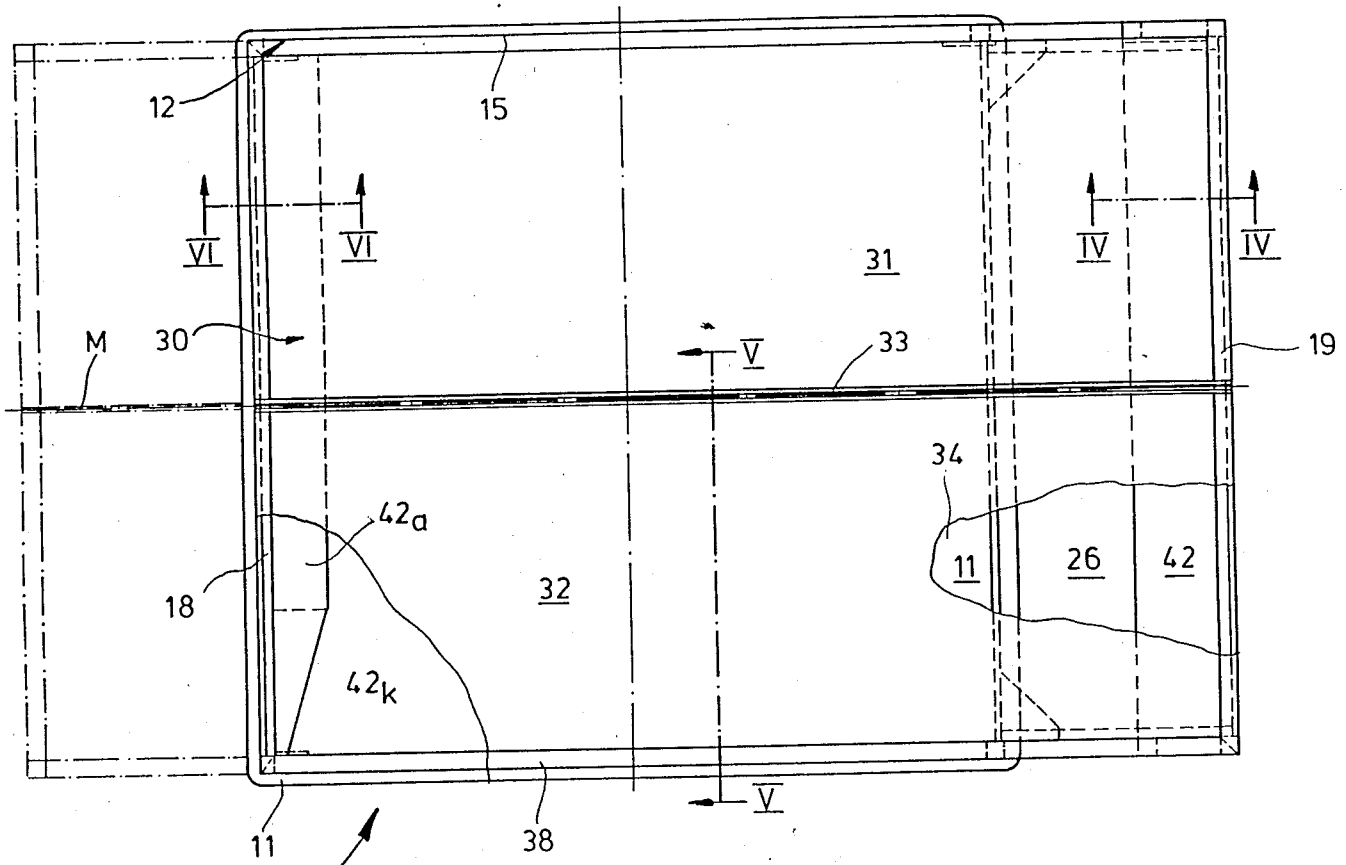
FIG. 3 shows a plan view of FIG. 1.

In FIG. 2, 28 indicates intersecting tensioning struts. With regard to the remainder of the diagram, as indicated at 24', the freight container 10 can have a container overhand 24, 24' on both sides.

Figure 5:
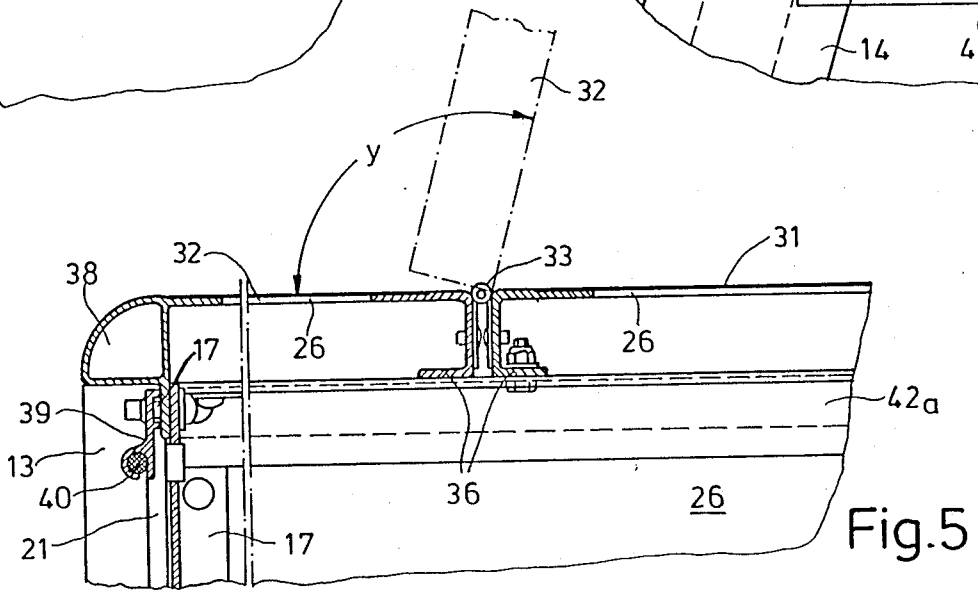
FIG. 5 shows an enlarged partial section through FIG. 3 along the line V—V in that figure.
Figure 6:
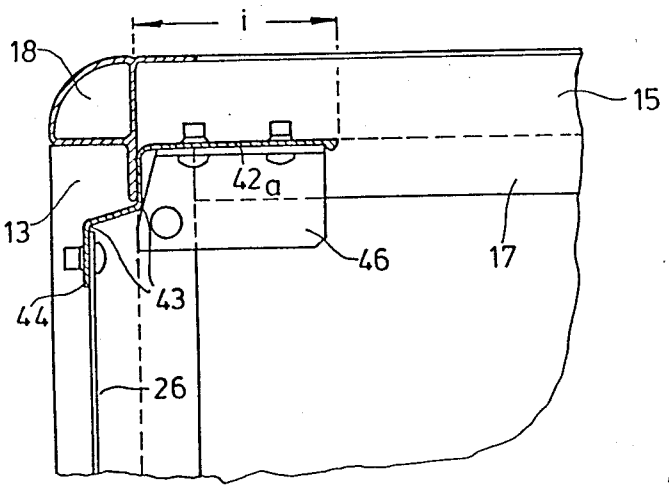
FIG. 6 shows an enlarged partial section through FIG. 3 along the line VI—VI in that figure.

The container roof 30 comprises, on the one hand, a fixed plate 31, which is fixed to the ridge section 15 and the transverse sections 18, 19 and extends as far as the center axis M and, on the other hand, a fold-back cover 32 which, according to FIG. 5, can be pivoted in the pivoting direction y about one or more hinges 33 and, in the open position, frees part of the area of the container roof to form a roof opening 34. Together with the side opening 20, the latter forms a common loading opening 20/34.

Both the plates 31 and the fold-back cover 32 have a frame having channel sections 36 near the hinge. At the front, the fold-back cover 32 is delimited by a hollow section 38, to the section web 17 of which a hinge section 39 having a weatherstrip 40 for the tarpaulin 21 is fixed.

Figure 4:
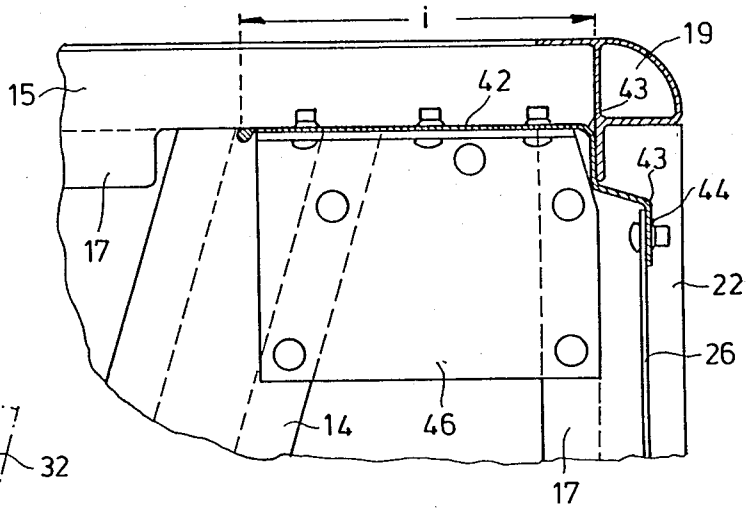
FIG. 4 shows an enlarged partial section through FIG. 3 along the line IV—IV in that figure.

Adjoining the transverse section 19, there is, as shown in FIG. 4, a connecting section 42 of a width i of approximately 150 mm which is bent to form two step edges 43 so that a connecting strip 44 overlaps the upper edge of the sheeting 26 and is riveted to its outer surface. This connecting section 42 is connected to the vertical bar 22 and the inclined section 14 by means of end-mounted angular butt straps or struts 46 and ties the inclined section firmly.

A narrower connecting section 42*a* (il=80 mm) comes into contact with the transverse section 18 and, in plan view, is tapered towards the side opening (region 42*k*).

Figure 7:
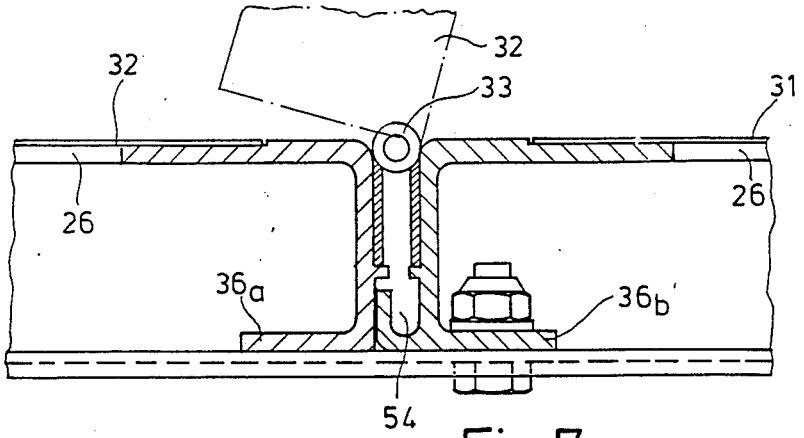
FIG. 7 shows an enlarged detail of FIG. 5, forming a different embodiment.
Figure 8:
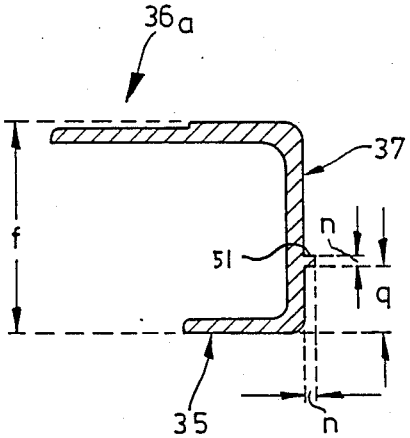
FIGS. 8 and 9 show individual elements from FIG. 7.
Figure 9:
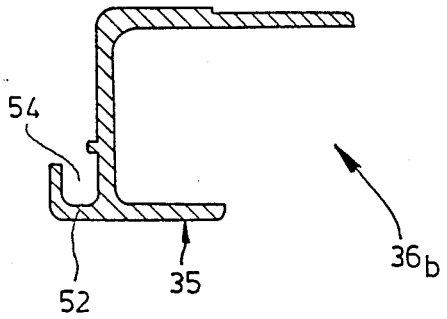

In the case of the exemplary embodiment of FIG. 7, the channel sections 36*a*, 36*b* having a height f of, in this case, 35 mm are in each case provided on their outer surfaces 37, at a distance q of 11 mm from their bearing surfaces 35, with a projecting strip 51 of a width n of 2 mm as a molded extension. In addition, the right-hand channel section 36*b* in FIG. 7 has a molded-on hook-shaped strip 52, which forms a channel space 54 underneath the projecting strip and presses against the other channel section 36*a*. This provides a tight roof seal with the possibility of draining off to one side water which may be encountered at the hinge 33.

What is claimed is:

1. Freight container for air transport which comprises a baseplate, support frame arranged on the baseplate, said support frame having sections rising from the baseplate and transverse sections connecting the rising sections for a container roof sheeting which at least partially fills in the support frame, one side of the freight container being provided with a lateral loading opening, a gap immediately adjoining the lateral loading opening in the container roof, and a pivotable or displaceable portion of the container roof operative to close said gap formed by a fold-back cover which is articulated approximately at the center axis (M) of the container roof, including a hollow section adjacent said pivotable portion, wherein the fold-back cover together with the hollow section forms one edge of the container roof and a connecting section on each side of the gap in the container roof for providing transverse reinforcement, each said connecting section being at a right angle to the loading opening underneath the pivotal portion and being fixed at both ends to the support frame, and each said connecting section having a molded extension overlapping adjacent sheeting and being fixed to an outer surface thereof.

2. Freight container according to claim 1 including two inclining sections which slope with respect to the baseplate and one of which delimits the loading opening, both inclined sections being connected by their upper ends to the connecting section.

3. Freight container according to claim 2 wherein one inclined section is connected to a vertical bar by an angular butt strut.

4. Freight container according to claim 1 wherein the connecting section is connected firmly at at least one end and by an angular butt strut to one of the rising sections.

5. Freight container according to claim 1 wherein the pivotable portion is connected along one frame section and by means of at least one joint or hinge to a parallel, fixed frame section of the container roof.

6. Freight container according to claim 1 including a projecting strip, at a distance (q) to a bearing surface of the frame section, on the outer surface thereof.

7. Freight container according to claim 6 wherein the projecting strips of each of the adjacent frame section is a stop for hinge parts.

8. Freight container according to claim 6 including a hook-shaped strip which is located in the region of the bearing surface of the frame section, is molded onto the latter and forms a channel which, as seen in cross-section, bridges the gap between adjacent frame sections.

* * * * *